US006381921B1

(12) United States Patent
Tale' et al.

(10) Patent No.: US 6,381,921 B1
(45) Date of Patent: May 7, 2002

(54) WRAPPING WHEEL OF A CIGARETTE PACKING MACHINE

(75) Inventors: Fabrizio Tale', Bologna; Alberto Polazzi, Rastignano; Mario Spatafora, Bologna, all of (IT)

(73) Assignee: G.D Societa' per Azioni, Pomponia (IT)

( * ) Notice: Subject to any disclaimer, the term of this patent is extended or adjusted under 35 U.S.C. 154(b) by 47 days.

(21) Appl. No.: 09/586,244

(22) Filed: Jun. 2, 2000

(30) Foreign Application Priority Data

Jun. 3, 1999 (IT) ..... BO99A0303

(51) Int. Cl.[7] ..... B65B 11/32

(52) U.S. Cl. ..... 53/234; 53/233; 53/372.5; 53/378.3; 493/177

(58) Field of Search ..... 53/233, 234, 226, 53/370.6, 372.5, 376.4, 378.3; 493/177, 425

(56) References Cited

U.S. PATENT DOCUMENTS 2,599,393 A * 6/1952 Kindseth ..... 53/372.5
2,911,779 A * 11/1959 Luczek ..... 53/370.6
3,269,092 A * 8/1966 McDonald ..... 53/372.5
3,602,107 A * 8/1971 Zimmer et al. ..... 493/177
4,000,599 A * 1/1977 Ferrozzi ..... 493/177
4,539,002 A * 9/1985 Zak ..... 493/177
5,410,858 A * 5/1995 Osti et al. ..... 53/371.5
5,802,819 A * 9/1998 Boldrini ..... 53/234
6,223,506 B1 * 5/2001 Ghini et al. ..... 53/234

FOREIGN PATENT DOCUMENTS

EP 0806347 A 11/1997
GB 2227222 A * 7/1990 ..... 53/234

* cited by examiner

*Primary Examiner*—John Sipos
(74) *Attorney, Agent, or Firm*—Marshall, Gerstein, & Borun.

(57) ABSTRACT

A wrapping wheel of a continuous cigarette packing machine has at least one seat for a respective group of cigarettes having two end surfaces and enclosed in a tubular wrapping having two projecting tubular end portions, each having two minor walls; the wheel moves each end surface along a relative path crosswise to the relative two minor walls, which are each folded onto the end surface by a relative folding device, which has an outer surface tangent to the end surface, and is mounted for rotation about a respective axis converging towards a plane defined by the path traveled by the end surface.

11 Claims, 4 Drawing Sheets

WRAPPING WHEEL OF A CIGARETTE PACKING MACHINE

The present invention relates to a wrapping wheel of a cigarette packing machine.

BACKGROUND OF THE INVENTION

In the tobacco industry, a continuous cigarette packing machine is known, which comprises a wrapping wheel mounted to rotate continuously about a respective axis of rotation, and in turn comprising at least one seat for a respective group of cigarettes enclosed in a respective tubular wrapping oriented with its longitudinal axis parallel to the axis of rotation of the wrapping wheel. The tubular wrapping normally has two tubular end portions, each projecting axially beyond a respective end surface of the group of cigarettes, and each comprising two parallel walls.

As the wrapping wheel rotates continuously, each end surface of the group of cigarettes is conveyed at a given speed and in a given traveling direction along a respective annular path, which extends crosswise to said two walls of the respective tubular end portion of the tubular wrapping and in a respective plane about the axis of rotation of the wrapping wheel. In the course of the above movement, folding devices engage and fold said two walls of each tubular portion onto the relative end surface of the group of cigarettes.

Said folding devices normally comprise, for each seat on the wrapping wheel, a movable folding device supported by the wrapping wheel and for folding, of said two walls, the one located at the rear in the traveling direction; and a fixed folding device supported by the packing machine in a fixed position along the path of the seats, and for folding, of said two walls, the one located at the front in the traveling direction of the seats.

Known folding devices of the type described above are not normally suitable for use over a given maximum operating speed, above which, the impact of the tubular wrapping, and in particular of said front wall, against the fixed folding device may easily result in tearing of the tubular wrapping.

One possible solution to the problem is to fit the wrapping wheel, for each seat, with a movable folding device for the rear wall, and a further movable folding device for the front wall.

Such a wrapping wheel, however, is relatively complicated and expensive, on account of the relatively complex movements performed by the movable folding devices, and which therefore call for relatively expensive, normally cam-type, actuating devices.

SUMMARY OF THE INVENTION

It is an object of the present invention to provide a wrapping wheel designed to eliminate the aforementioned drawbacks.

According to the present invention, there is provided a wrapping wheel of a cigarette packing machine, the wrapping wheel having a first axis of rotation and comprising at least one seat for a respective group of cigarettes enclosed in a respective tubular wrapping oriented with a respective longitudinal second axis parallel to said first axis and having at least one tubular end portion, which projects axially beyond a respective end surface of said group and comprises two parallel walls; and folding means for folding said two walls of said tubular end portion onto the relative said end surface; said wrapping wheel being mounted to rotate about said first axis to move each said end surface at a first speed and in a given first direction along a relative annular first path crosswise to said two walls and extending in a relative plane about the first axis; and being characterized in that said folding means comprise at least one folding device, which has an outer surface tangent to a relative said first path and comprises at least one folding member, and actuating means for moving the folding member in a given second direction along an annular second path, a projection of which in the relative said plane comprises a portion substantially coincident with a portion of the first path.

BRIEF DESCRIPTION OF THE DRAWINGS

A non-limiting embodiment of the invention will be described by way of example with reference to the accompanying drawings, in which.

DETAILED DESCRIPTION OF THE INVENTION

Figure 1:
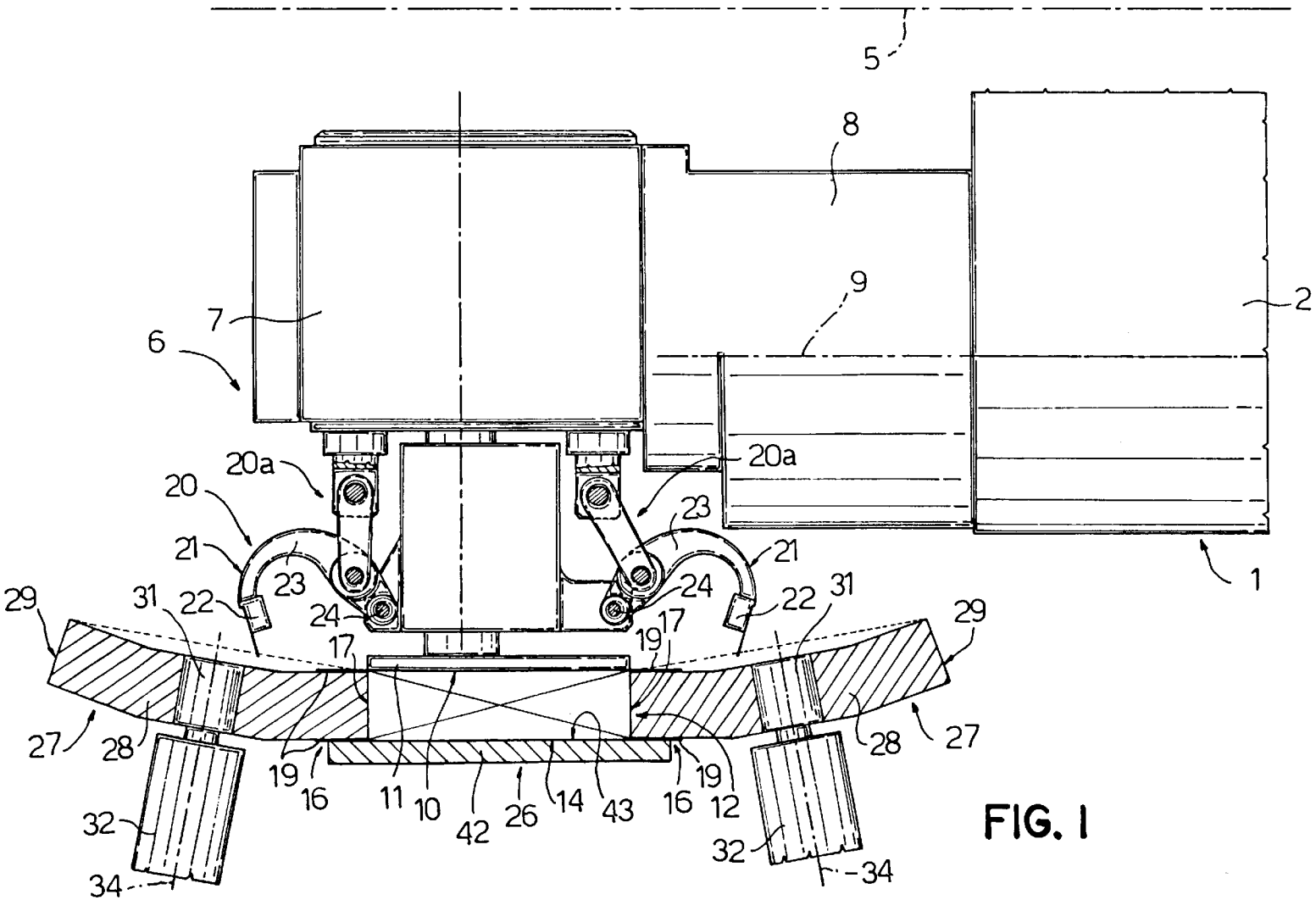
FIG. 1 shows a schematic axial section, with parts removed for clarity, of a preferred embodiment of the wrapping wheel according to the present invention.

Number 1 in FIG. 1 indicates as a whole a wrapping wheel of a cigarette packing machine. Wheel 1 comprises a drum 2, which is fitted to a powered shaft (not shown) to rotate continuously at a given speed in a direction 4 (clockwise in FIG. 6) about an axis 5.

Drum 2 comprises a number of peripheral conveying and wrapping units (or even only one conveying and wrapping unit), only one of which is shown and indicated 6 in FIG. 1. Unit 6 extends radially outwards, is fed by wheel 1 in direction 4, and comprises a frame 7 extending radially outwards from the periphery of drum 2 and fitted on the inner end with a shaft 8, which is fitted in rotary manner through drum 2 and oscillated, with respect to drum 2 and about an axis 9 parallel to axis 5, by a known cam actuating device (not shown).

Unit 6 comprises a substantially U-shaped seat 10 fitted to a free end of respective frame 7 and having a concavity facing radially outwards. Seat 10, which is of known type, comprises a bottom wall 11 extending parallel to axis 9, and two lateral walls (not shown) parallel to the FIG. 1 plane, and houses a substantially parallelepipedal, substantially rectangular-section group 12 of cigarettes 13.

Figure 4:
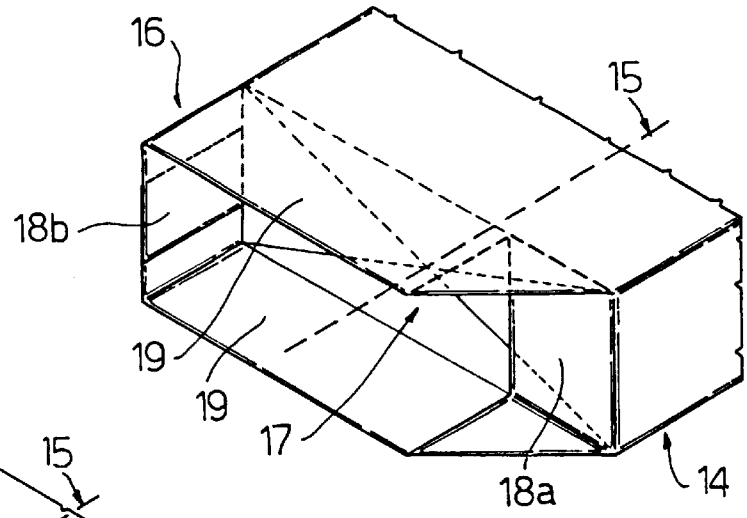
FIGS. 4 and 5 show two partial views in perspective of a group of cigarettes and a respective inner wrapping at two successive folding steps.
Figure 5:
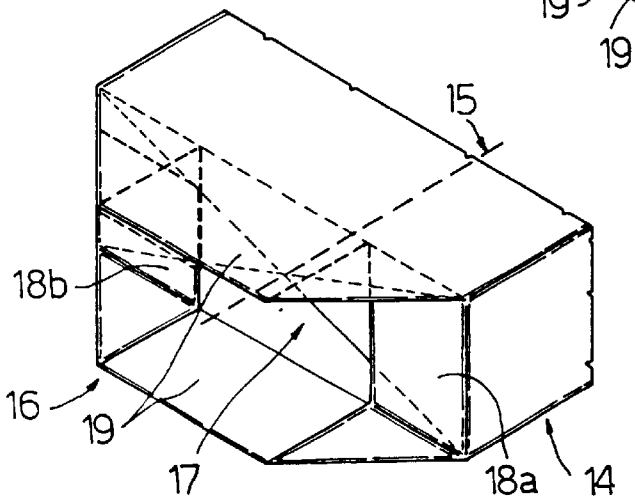

As shown more clearly in FIGS. 4 and 5, group 12 is enclosed in a tubular wrapping 14 having a longitudinal axis 15 and comprising two tubular end portions 16, each of which projects axially beyond a respective end surface 17 of group 12 and comprises two parallel minor walls 18 and two parallel major walls 19 perpendicular to walls 18. When group 12 is housed inside seat 10, axis 15 of wrapping 14 is parallel to axis 9; one of walls 18—hereinafter indicated 18*a*—is located at the front in direction 4; and the other wall 18—hereinafter indicated 18*b*—is located at the rear in direction 4.

With reference to FIG. 1, unit 6 comprises a gripping device 20, which cooperates with bottom wall 11 and with the lateral walls (not shown) of seat 10 to retain group 12 inside seat 10.

Gripping device 20 in turn comprises two jaws 21, each of which comprises a gripping head 22 and a curved rod 23, which is hinged to the free end of frame 7 and oscillated—with respect to frame 7 and by a known actuating device 20*a* with cam-controlled rods (not shown)—about a pin 24, crosswise to axis 9 and perpendicular to the FIG. 1 plane, to and from a position gripping respective group 12 against wall 11.

Figure 6:
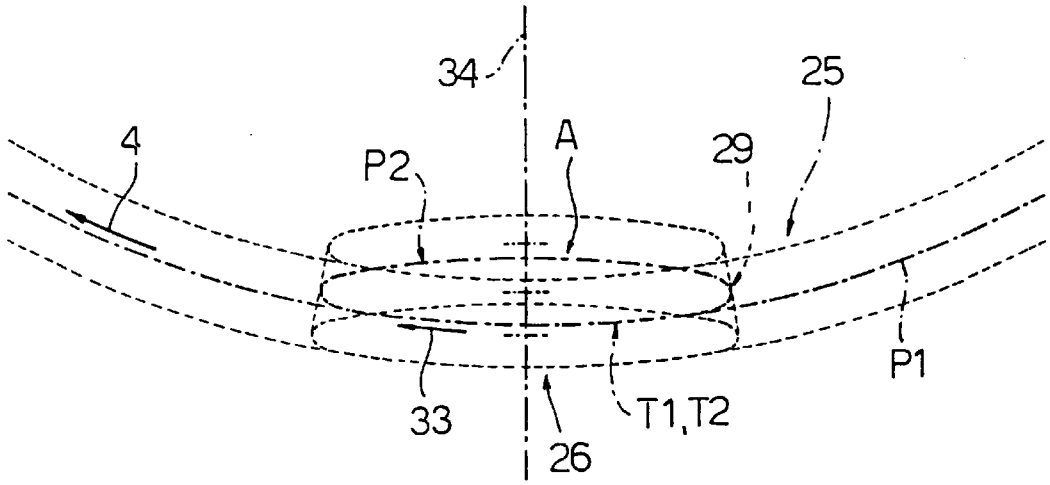
FIG. 6 shows an operating diagram illustrating the trajectories of various FIG. 1 details, projected in a plane perpendicular to the FIG. 1 plane.

Rotating about axis 5, wheel 1 feeds group 12 in direction 4, and therefore feeds each end surface 17 along a respective annular path P1 (FIG. 6), which extends in a plane 25 coincident with the FIG. 6 plane and crosswise to walls 18 of relative tubular portion 16, and through a folding station 26.

With reference to FIG. 1, wheel 1 also comprises two folding devices 27 located at folding station 26 and each comprising a respective star-shaped wheel 28, which has a substantially truncated-cone-shaped outer surface 29 tangent to relative path P1, and is of a thickness measured parallel to a respective generating line approximately equal to but no greater than the distance between major walls 19 of wrapping 14. It should be pointed out that, for producing the outer wrappings of soft packs of cigarettes, for example, wheel 1 may comprise only one folding device 27.

With reference to FIGS. 2 and 3, each wheel 28 comprises a central hub 30, which is fitted to an output shaft 31 of a known actuating device 32 for rotating wheel 28 in a direction 33 (clockwise in FIG. 6) about an axis 34 of shaft 31. More specifically, and as shown in FIG. 1, axis 34 is so oriented as to converge towards relative plane 25 and towards the axis 34 of the other device 27.

Each wheel 28 also comprises three substantially boot-shaped folding members 35 equally spaced about axis 34. Each folding member 35 comprises an arm 36 extending radially outwards from hub 30; and a folding head 37, which is integral with the free end of arm 36, and is defined by an end surface 38 forming part of outer surface 29 of wheel 28, and by two lateral surfaces, one of which is located to the front in direction 33 and hereinafter indicated 39, and the other of which is located to the rear in direction 33 and hereinafter indicated 40. Surface 40 extends in a substantially radial direction with respect to hub 30, while surface 39 extends in a direction substantially crosswise to surface 40, and is connected to surface 38 by a plowshare-shaped tip 41.

With reference to FIG. 6, as each wheel 28 rotates about respective axis 34, each head 37 travels along a relative path P2 tangent to relative path P1. Because of the orientation of axis 34 with respect to relative plane 25, the projection of circular path P2 in plane 25 is an elongated ellipse A, which extends inside relative path P1 and has a portion T2 substantially coincident with a portion T1 of relative path P1.

The following description deals, by way of example, with a wheel 1 comprising one seat 10 housing a group 12 of cigarettes 13 having a tubular wrapping 14, of which is considered only one tubular portion 16 cooperating with relative folding device 27.

With reference to FIGS. 2 and 3, in actual use, wheel 1 feeds seat 10 to folding station 26 where wheel 1 comprises a plate 42 (FIG. 1) coaxial with axis 5 and defining, together with bottom wall 11, a channel 43 for the passage of group 12. At the input of station 26, the two jaws 21 may therefore be moved into an open position, and plate 42 cooperates with wall 11 and with said lateral walls (not shown) of seat 10 to retain group 12 firmly inside seat 10.

Figure 2A:
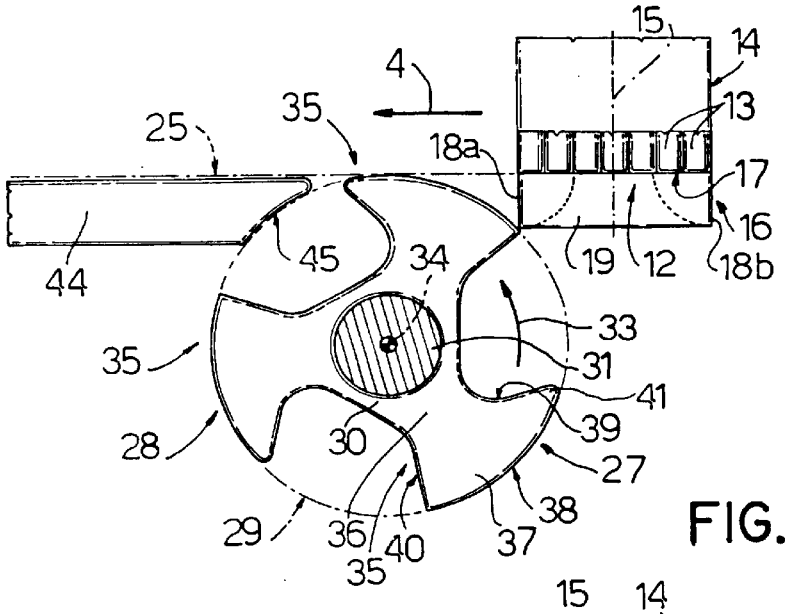
FIGS. 2*a*–2*c* and 3*a*–3*c* show projections, in a horizontal plane, of a FIG. 1 detail in various distinct operating positions.

Actuating device 32 of the folding device 27 considered is activated in time with conveying and wrapping unit 6 at the input of station 26, so as to bring the free edge of wall 18*a* of the tubular portion 16 considered into contact with the free edge of surface 40 of a relative folding member 35 (FIG. 2*a*) . Device 32 is a variable-speed device for imparting a variable angular speed to wheel 28 and, hence, a variable linear speed to each head 37. More specifically, when the free edge of wall 18*a* is positioned contacting the free edge of surface 40 of relative folding member 35, the linear speed of relative head 37 is so controlled as to be less than the speed of seat 10 and so enable wrapping 14 to move over folding member 35, and folding member 35 to fold wall 18*a* onto relative end surface 17.

Figure 2B:
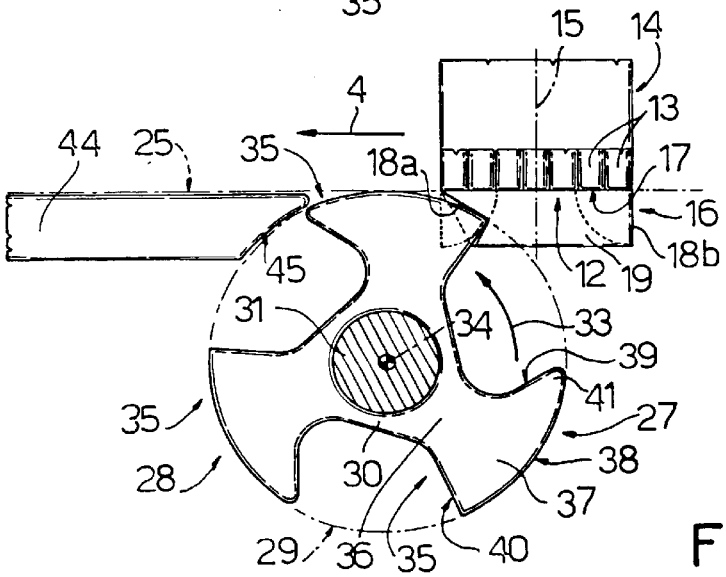
Figure 2C:
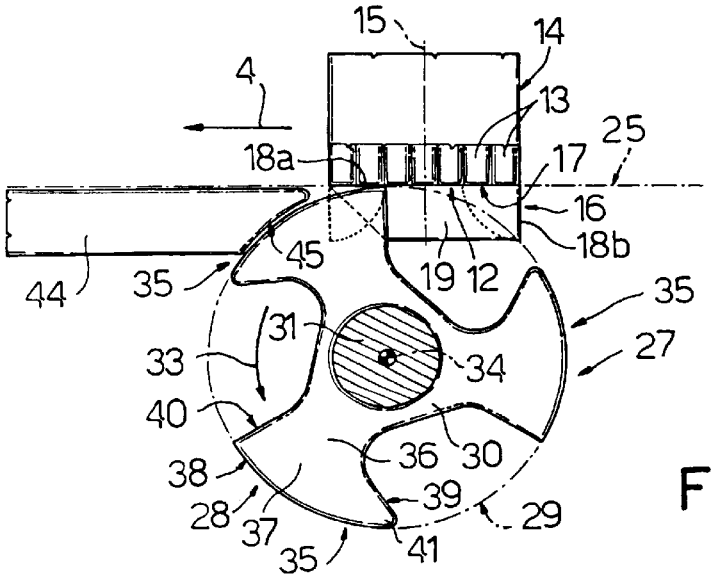

In the course of the above folding operation, the linear speed of folding member 35 is also so controlled as to keep said free edge of folding member 35 permanently contacting the free edge of wall 18*a*, and so substantially prevent any relative slide between folding member 35 and wall 18*a* (FIGS. 2*b* and 2*c*).

At the output of folding station 26, wall 18*a* of wrapping 14 is maintained contacting relative end surface 17 (FIG. 3*a*) by a retaining plate 44 tangent to plane 25 and extending along a portion of path P1 from the output of station 26.

Figure 3A:
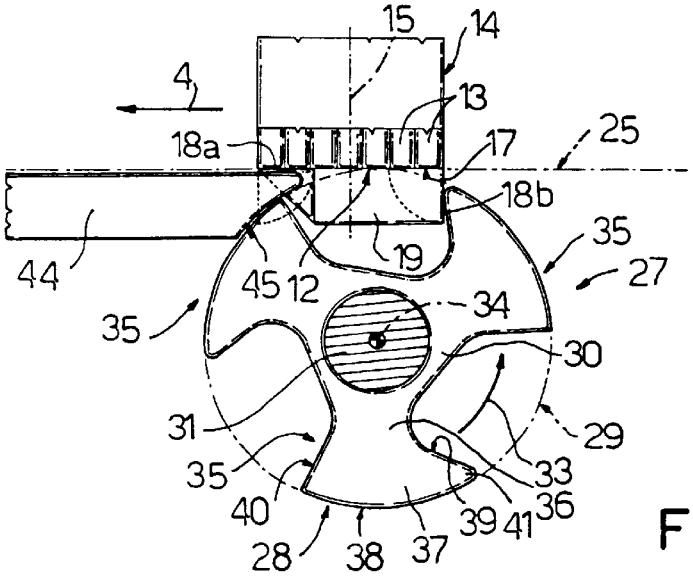
Figure 3B:
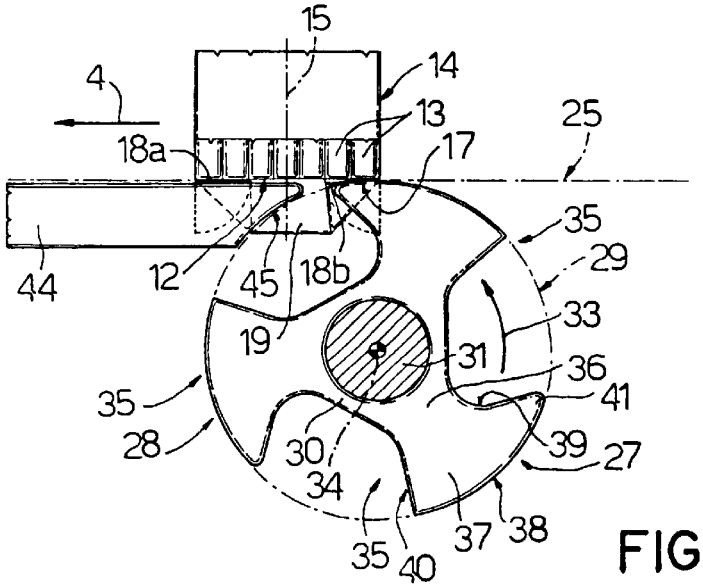
Figure 3C:
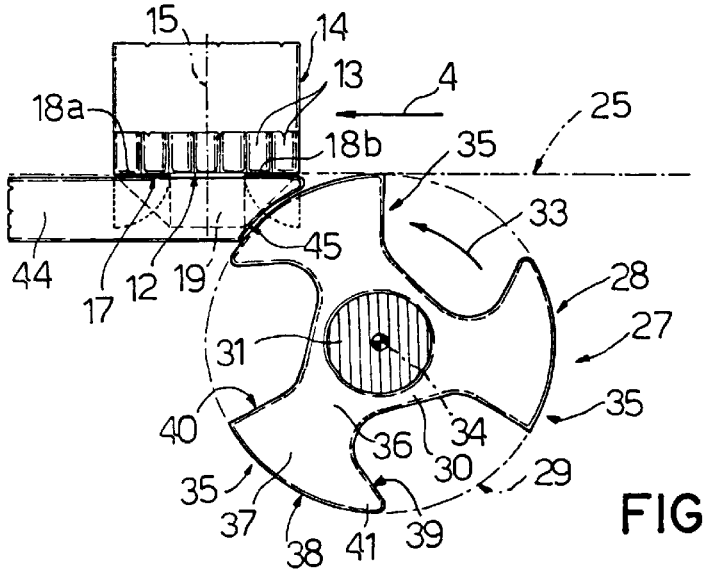

After folding wall 18*a*, wheel 28 is accelerated by device 32 to a speed greater than that of seat 10 to enable the next folding member 35, following the folding member 35 which has just folded wall 18*a*, to catch up with seat 10 and bring surface 39, in particular tip 41, into contact with wall 18*b* of wrapping 14 (FIG. 3*a*)

The linear speed of relative head 37 is then so controlled further as to be greater than the speed of seat 10 and so enable the folding member 35 considered to move over wrapping 14 and fold wall 18*b* (FIG. 3*b*) onto relative end surface 17.

Once wall 18*b* is folded as described above, end surface 38 of relative folding member 35 is maintained contacting wall 18*b* substantially until the free edge of wall 18*b* engages plate 44 (FIG. 3*c*), the initial portion of which, facing wheel 28, is appropriately recessed underneath by a surface 45 coaxial with axis 34.

Operation as described above is made possible by portion T2 of path P2 coinciding with portion T1 of path P1, so that, at portion T2, heads 37 can travel along path P1 of wrapping 14 to engage walls 18*a* and 18*b*, but not walls 19.

In a variation (not shown) of the present invention, wheel 1 may be step-operated; in which case, folding members 35 of wheel 28 act on walls 18*a* and 18*b* in the course of rotation steps of wheel 1.

What is claimed is:

1. A wrapping wheel of a cigarette packing machine, the wrapping wheel (1) having a first axis (5) of rotation and comprising at least one seat (10) for a respective group (12) of cigarettes (13) enclosed in a respective tubular wrapping (14) oriented with a respective longitudinal second axis (15) parallel to said first axis (5) and having at least one tubular end portion (16), which projects axially beyond a respective end surface (17) of said group (12) and comprises two parallel walls (18); and folding means (27) for folding said two walls (18) of said tubular end portion (16) onto the relative said end surface (17); said wrapping wheel (1) being mounted to rotate about said first axis (5) to move each said end surface (17) at a first speed and in a given first direction (4) along a relative annular first path (P1) crosswise to said two walls (18) and extending in a relative plane (25) about the first axis (5); and being characterized in that said folding means (27) comprise at least one folding device (27), which has an outer surface (29) tangent to a relative said first path (P1) and comprises at least one folding member (35), and actuating means (32) for moving the folding member (35) in a given second direction (33) along an annular second path (P2), a projection of which in the relative said plane (25) comprises a portion (T2) substantially coincident with a portion (T1) of the first path (P1), said second path is a circular path about a third axis converging towards said first axis.

2. A wrapping wheel as claimed in claim 1, characterized in that each said tubular wrapping (14) comprises two tubular end portions (16), each of which projects axially beyond a respective end surface (17) of the relative group (12) and comprises two parallel walls (18); said folding means (27) comprising two said folding devices (27), each of which has an outer surface (29) tangent to a relative said first path (P1) and comprises at least one folding member (35), and actuating means (32) for moving the folding member (35) in a given second direction (33) along said annular second path (P2), a projection of which in the relative said plane (25) comprises a portion (T2) substantially coincident with a portion (T1) of the first path (P1).

3. A wrapping wheel as claimed in claim 1, characterized in that said second path (P2) comprises two paths, each if which is a circular path extending about a respective third axis (34) of rotation.

4. A wrapping wheel as claimed in claim 3, characterized in that said third axes (34) converge towards each other and towards said first axis (5).

5. A wrapping wheel as claimed in claim 1, characterized in that said outer surface (29) comprises two paths, each if which is a truncated-cone-shaped surface having a third axis (34) converging towards the relative said plane (25) and towards said first axis (5).

6. A wrapping wheel as claimed in claim 1, characterized in that said projection is substantially in the form of an ellipse (A).

7. A wrapping wheel as claimed in claim 3, characterized in that each said folding device (27) comprises a central hub (30) connected to the relative said actuating means (32) to rotate about the relative third axis (34); and said folding member (35) is substantially boot-shaped and comprises an arm (36) extending radially from said hub (30), and a folding head (37) integral with a free end of said arm (36) and defined by a first end surface (38) forming part of said outer surface (29), and by a second and a third lateral surface (40, 39) located respectively at the rear and at the front in said second direction (33), and for respectively engaging a first (18*a*) of said walls (18), located at the front in said first direction (4), and a second (18*b*) of said walls (18), located at the rear in said first direction (4).

8. A wrapping wheel as claimed in claim 7, characterized in that said second lateral surface (40) extends in a direction substantially radial with respect to said hub (30); and said third lateral surface (39) extends in a direction substantially crosswise to said second lateral surface (40).

9. A wrapping wheel as claimed in claim 7, characterized in that each said folding device (27) comprises a truncated-cone, star-shaped wheel (28) in turn comprising said hub (30) and at least two said folding members (35) extending outwards from said hub (30).

10. A wrapping wheel as claimed in claim 9, characterized in that said folding members (35) are three in number and equally spaced about the relative said third axis (34).

11. A wrapping wheel as claimed in claim 1, characterized in that said actuating means (32) are variable-speed actuating means for imparting to each said folding device (27) a second speed which is less than said first speed when folding a first (18*a*) of said walls (18) located at the front in said first direction (4), and is greater than said first speed when folding a second (18*b*) of said walls (18) located at the rear in said first direction (4).

* * * * *

UNITED STATES PATENT AND TRADEMARK OFFICE

CERTIFICATE OF CORRECTION

PATENT NO. : 6,381,921 B1
DATED : May 7, 2002
INVENTOR(S) : Fabrizio Talé et al.

It is certified that error appears in the above-identified patent and that said Letters Patent is hereby corrected as shown below:

Column 5,
Line 28, "if" should be -- of --
Line 35, "if" should be -- of --

Signed and Sealed this

Eleventh Day of February, 2003

JAMES E. ROGAN
*Director of the United States Patent and Trademark Office*